US012024900B2

(12) United States Patent
Favero

(10) Patent No.: US 12,024,900 B2
(45) Date of Patent: Jul. 2, 2024

(54) CONFIGURABLE BASE FOR SUPPORTS FOR RAISED FLOORS AND SUPPORT FOR RAISED FLOORS COMPRISING SAID CONFIGURABLE BASE

(71) Applicant: Eterno Ivica Srl, Padua (IT)

(72) Inventor: Gabriele Favero, Padua (IT)

( * ) Notice: Subject to any disclaimer, the term of this patent is extended or adjusted under 35 U.S.C. 154(b) by 21 days.

(21) Appl. No.: 18/166,165

(22) Filed: Feb. 8, 2023

(65) Prior Publication Data

US 2024/0076883 A1 Mar. 7, 2024

(30) Foreign Application Priority Data

Sep. 2, 2022 (IT) ..... 102022000002363

(51) Int. Cl.
*E04F 15/024* (2006.01)

(52) U.S. Cl.
CPC ..... *E04F 15/02447* (2013.01)

(58) Field of Classification Search
CPC ..... E04F 11/035; E04F 15/02447; E04F 15/02494
USPC ..... 248/346.3, 349.1
See application file for complete search history.

(56) References Cited

U.S. PATENT DOCUMENTS 9,038,324 B2 * 5/2015 Kugler ..... E04F 15/02464 52/126.6
9,284,693 B2 * 3/2016 Tabibnia ..... F24D 3/122
9,410,296 B2 * 8/2016 Tabibnia ..... E04F 15/02447
9,441,336 B2 * 9/2016 Leahy ..... E01F 9/635
2023/0212859 A1 * 7/2023 Favero ..... E04F 11/035 52/182

FOREIGN PATENT DOCUMENTS

FR 3082544 12/2019
WO 2021229485 11/2021

OTHER PUBLICATIONS

Italian Patent and Trademark Office, Search Report, Sep. 23, 2022 (Relevant portions are in English).

* cited by examiner

*Primary Examiner* — Todd M Epps
(74) *Attorney, Agent, or Firm* — Themis Law

(57) ABSTRACT

A base for supporting raised floors includes a planar part configured to rest and fix the base onto the ground, and a raised part joined to and extending from the planar part. The planar part has a straight first cut and/or at least a first series of holes aligned along a line dividing the planar part in at least two parts, thus defining a line that facilitates a breaking action for the separation of a detachable part from the planar part.

10 Claims, 2 Drawing Sheets

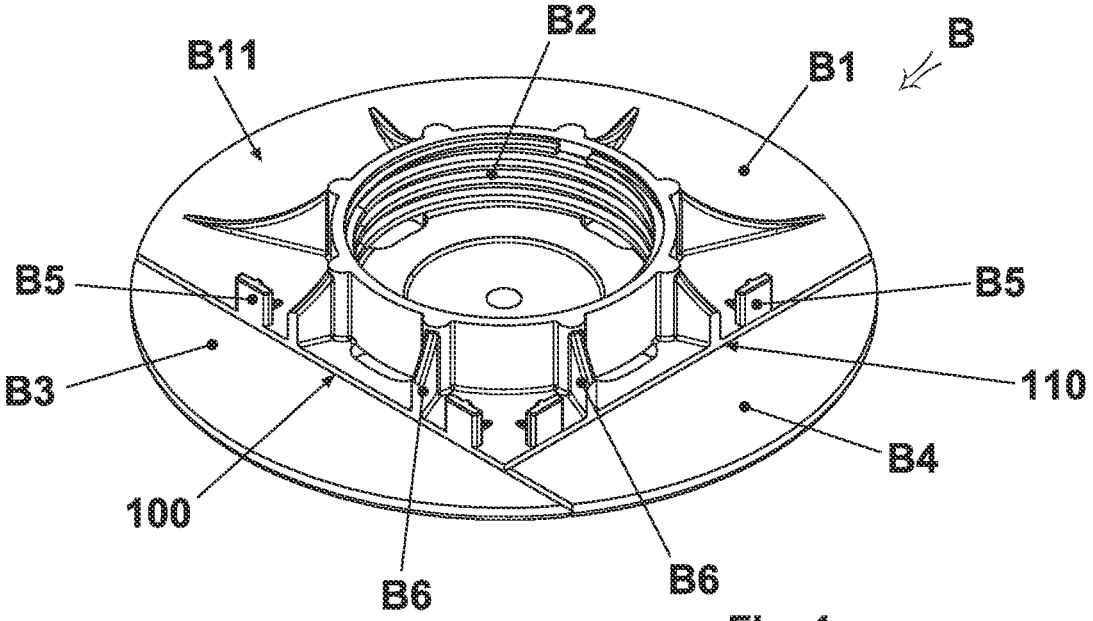
Fig. 1
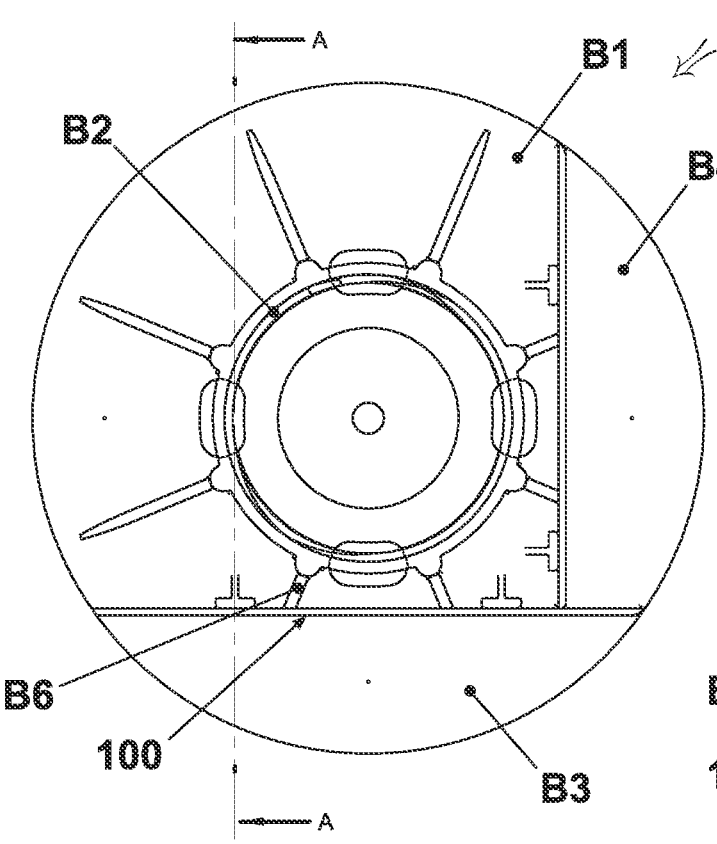
Fig. 2
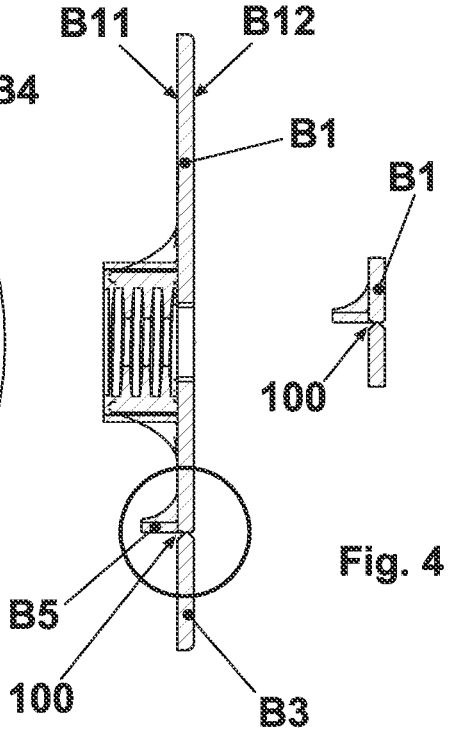
Fig. 4
Fig. 3

CONFIGURABLE BASE FOR SUPPORTS FOR RAISED FLOORS AND SUPPORT FOR RAISED FLOORS COMPRISING SAID CONFIGURABLE BASE

FIELD OF THE INVENTION

The present invention concerns supports for raised floors. More specifically, the present invention concerns a base for supports for raised floors, which can be shaped by means of a facilitated manual breaking action, and a support for raised floors comprising said base.

BACKGROUND OF THE INVENTION

Currently, in order to create raised floors on supporting surfaces in general, the first step consists in laying conveniently spaced supports, on which the panels forming the floor or the joists forming a substructure to support the floor panels are directly placed at a later moment.

The supports for raised floors usually consist of a base suited to be rested on the ground, a substantially cylindrical or tubular intermediate body extending from said base, and a head on said intermediate body, said head having a flat upper surface on which the panels or elements forming the floor are laid.

More specifically, the size of said flat upper surface of the head is usually large enough to support the corners or part of the panels laid side by side to form the floor.

Supports with shock-absorbing and sound-absorbing elements suited to be positioned on said upper surface of the head are also known. Said shock-absorbing elements include, for example, layers of a few millimetres of elastic material.

Supports whose height is not adjustable are known, wherein said base, said intermediate body and said head constitute a single element.

In order to compensate for differences in slope between the ground, which often has to be inclined to allow rainwater to be drained, and the raised floor, which must be horizontal, supports have been designed and constructed in which said head has a convex lower surface suited to tilt in a corresponding concave seat created on the top of said intermediate body.

The adjustment or compensation of the inclination between the panels of the raised floor and the ground is therefore obtained by adjusting the inclination of the head in the concave seat in the intermediate body.

Supports are also known in which the head, instead, is configured so that it can be coupled with said intermediate body, in such a way that the head cannot tilt but only rotates around a longitudinal axis of the intermediate body.

Supports with adjustable height are also known, in which said base and said intermediate body are configured to be screwed to each other to an adjustable extent, consequently varying the overall height of the support.

Supports with adjustable height are also known which comprise, in addition to said intermediate body, a further body serving as an extension, also having a generically tubular shape and provided with a thread or other constraining elements suitable for ensuring the coupling with said intermediate body and said head and for allowing the overall height of the support to be adjusted.

The adjustment of the height of the supports is carried out by acting on said intermediate body or on said extension body by screwing/unscrewing or in any case by acting on said constraining elements.

In the case of supports whose height can be adjusted, said head is usually holed axially, so that the operator can insert a screwing tool through said hole.

For adjustments to be carried out in the case of greater differences in height, additional bodies are provided which are suited to be interposed and coupled with said base and/or with said intermediate body and/or with said extension body and/or with said head.

The flat upper surface of the head of the known supports can comprise vertical partitions, usually four and substantially orthogonal to said flat upper surface, which are arranged radially towards the centre of the circular shape of said upper surface, that is, arranged on the axes of symmetry of the surface itself to define the four right angles needed for positioning the edges of the floor panels.

The supports are distributed on the ground to be paved: the base is rested on and in some cases fixed to the ground, said intermediate body is coupled with said base and said head is coupled with or rested on said intermediate body.

Said base generally comprises a plane part resting on the ground and a raised part, normally in a cylindrical tubular shape, which rises from said plane part and is intended to be coupled with said intermediate body or with said additional bodies, if provided, or directly with said head.

Said plane part resting on the ground can be holed in such a way as to allow it to be constrained to the ground.

Said plane part of the base is usually circular, which gives origin to some drawbacks in the case where the base of the support needs to be positioned in proximity to an obstacle such as a vertical wall or step. In addition to the above, the raised floor to be obtained often comprises also one or more steps constituted by panels arranged vertically so as to form the risers of the steps.

Said risers must be constrained to the ground and to the upper horizontal panels that make up the floor.

It is known that L-shaped brackets, for example made of a metallic material, are used to fix a riser to a support. More specifically, each riser, for example, is constrained to at least one support by means of a first bracket constrained between the lower edge of the riser and the base of the support and by means of a second bracket constrained between the upper edge of the riser and the head of the support.

In order to be able to position the riser and the support correctly, it is therefore necessary for the support to be very close to the riser, which is prevented by the presence of said enlarged plane part of the base.

Currently, to solve this problem, operators cut a part of the base manually in such a way as to create a straight side on which the riser will be placed.

Said operation slows down the assembly work and requires the use of tools such as hacksaws or other tools.

The assembly procedures are further complicated in the case where the base of the support needs to be positioned at the level of a corner, in which case the operator must even shape said base so as to create two straight sides at 90° with respect to each other.

Analogously, in the case where a base must be positioned in a narrow space, the operator must shape the base according to the available space.

SUMMARY OF THE INVENTION

In order to overcome all the above-mentioned drawbacks, a new type of base of supports for raised floors has been designed and manufactured, which comprises a plane part suited to be rested on the ground and to be shaped by means of a facilitated manual breaking operation.

The main object of the present invention is to simplify the installation procedures for raised floors, thereby also optimizing the floor installation times, as according to the invention it is possible to shape the base directly at the time of laying, quickly and with no need for tools.

Another object is to make it possible to position the new base of the supports for raised floors in any assembly conditions.

Another object is to make it possible to position the bases of the supports without having to use tools to change their configuration.

These and other direct and complementary objects are achieved by the new base of supports for raised floors, comprising at least one plane part suited to be rested and fixed to the ground and a raised part, usually tubular and preferably cylindrical, joined to and extending from said plane part, and wherein said plane part is provided with at least one substantially straight cut and/or a series of holes aligned along at least one straight line, which divides said plane part into at least two parts and which creates a breaking line suited to facilitate the separation of said plane part into said at least two parts.

In the case where said plane part has, for example, a circular shape, the above-mentioned breaking line is positioned, for example, on a chord of the plane part, between said raised part and the perimeter of the plane part.

In this case, therefore, a first detachable part in the form of a circular segment can be separated from the plane part.

For example, said breaking line is tangent or in any case close to said raised tubular part.

In the preferred solution, said plane part comprises also a further straight cut or a further series of holes aligned along a second straight line that is orthogonal to said first breaking line, which thus gives origin to a second breaking line defining a second detachable part.

In practice, when a single part is detached by acting along said first breaking line, the plane part consequently features a straight side that allows the base to be positioned, for example, against a wall or a step or an obstacle in general.

On the contrary, when both of the detachable parts are separated by acting along both of said breaking lines, the plane part features a right angle suited to be positioned, for example, at the level of a corner between two walls.

In a possible further solution, said plane part comprises, as an alternative or in addition to the second breaking line orthogonal to the first breaking line, a further straight cut or a further series of holes aligned along a straight line that is parallel to said first breaking line.

In a possible further solution, said plane part comprises four straight cuts or series of holes aligned on mutually orthogonal lines, arranged around said raised part and thus defining four selectively detachable parts. In this configuration, detaching one or more of said parts along the breaking lines defined by the cuts makes it possible to shape the base in various manners according to the space available on the surface on which it needs to be rested.

The new base is suited to be used on any type of support for raised floors and especially on supports comprising said base, a possible intermediate body and a possible additional body, an upper head, tilting or non-tilting, on which the floor panels can be directly or indirectly laid.

BRIEF DESCRIPTION OF THE DRAWINGS

The characteristics of the new base are better clarified by the following description with reference to the drawing that is attached hereto by way of non-limiting example.

FIG. 1 shows a three-dimensional view of a base according to the invention.

FIG. 2 shows a plan view of the base of FIG. 1.

FIG. 3 shows a sectional view of the base of FIG. 2, along the sectional plane A-A shown in FIG. 2.

FIG. 4 shows a detailed view of the section of FIG. 3.

DETAILED DESCRIPTION OF EMBODIMENTS OF THE INVENTION

A base (B) according to the invention comprises a plane part (B1) (sometimes referred to as a planar part), which may be plane-shaped and is configured to be rested and fixed to the ground.

Said plane part (B1) has an upper surface (B11) with a raised part (B2) extending therefrom, said raised part (B2) being preferably tubular, and more preferably cylindrical, and suited to be connected to the other parts of a support for raised floors such as, for example, an intermediate body and/or the upper head intended to support the floor panels.

The opposite lower surface (B12) is suited to be rested on a plane in general.

In the solution shown in FIGS. 1, 2, 3 and 4, said plane part (B1) is provided with at least one first straight cut (100) arranged along a chord between said raised part (B2) and the perimeter of the plane part (B1) itself.

As shown in the detail of FIG. 4, said first cut (100) can be made on said upper surface (B11) and/or on said lower surface (B12) of said plane part (B1).

The depth of the cut (100) is such as to actually create a breaking line along which the plane part (B1) can be broken defining a detachable part (B3) in the shape of a circular segment.

In a preferred solution, said plane part (B1) also comprises at least one second straight cut (110), orthogonal to said first cut (100) and defining a second detachable part (B4).

According to the invention, partitions (B5) can extend orthogonally from said upper surface (B11) of said plane part (B1), wherein said partitions (B5) are arranged in proximity to said cuts (100, 110) and serve as supporting elements once said detachable parts (B3, B4) have been removed.

Said base (B) further comprises radial ribs (B6) belonging to said raised part (B2). According to the invention, also said radial ribs (B6) can be cut at the level of said cuts (100, 110) of the plane part (B1) or, as shown in FIGS. 1 and 2, said ribs (B6) can be truncated at the level of said cuts (100, 110).

Figure 6:
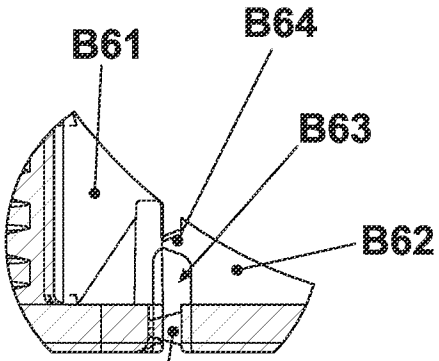
FIG. 6 shows the base of FIG. 5, where a rib has a joining point at a breaking line.
Figure 7:
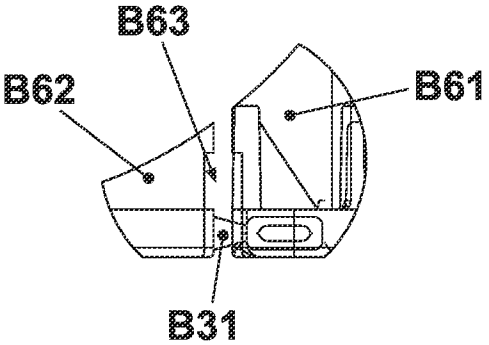
FIG. 7 show the base of FIG. 5, where a rib has no joining point at a breaking line.
Figure 5:
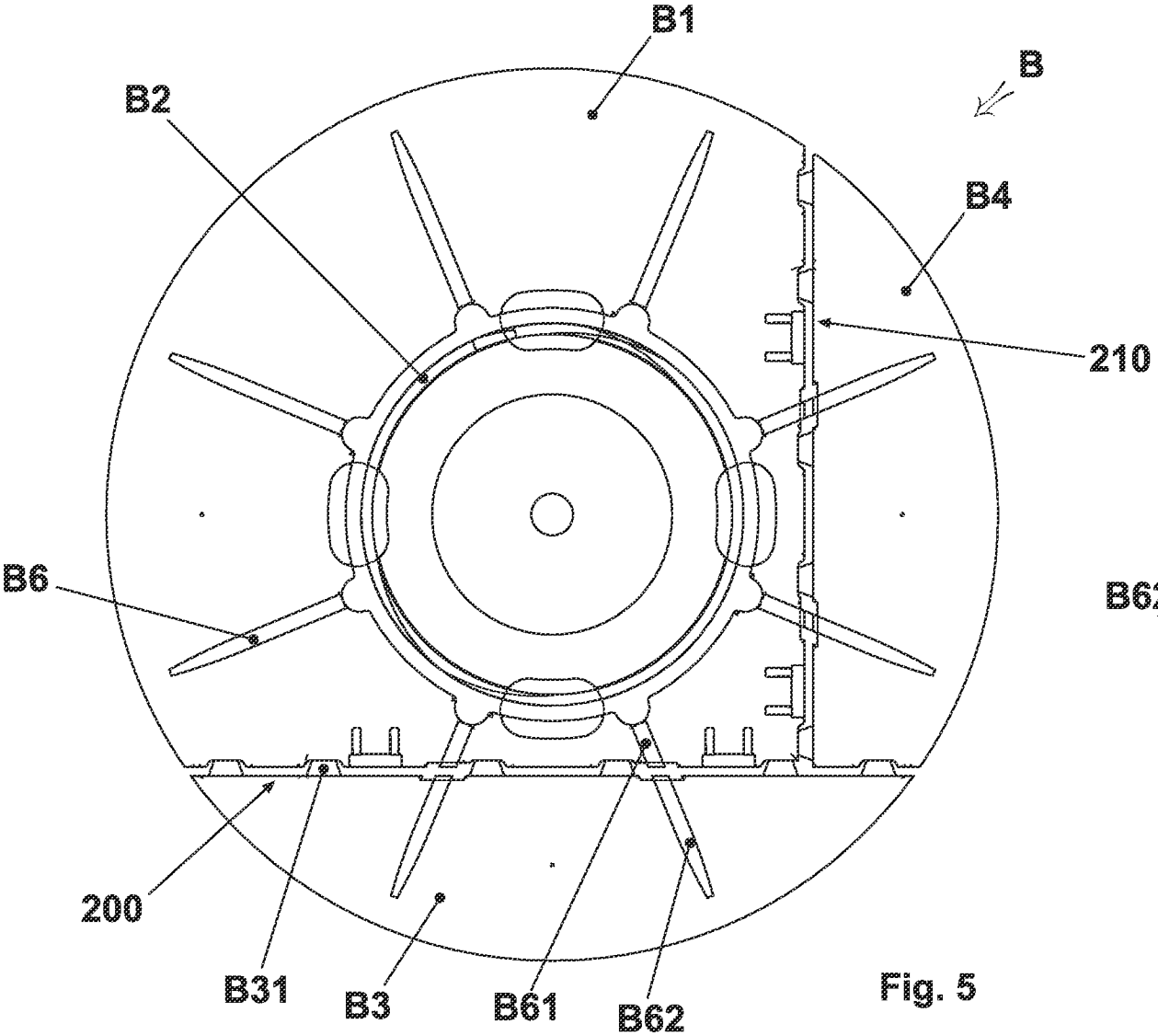
FIG. 5 shows a plan view of a base according to the invention.

The examples of FIGS. 5, 6 and 7 show that, according to the invention, said plane part (B1) of the base (B) can be provided, in addition or as an alternative to said cuts (100, 110), said plane part (B1) of the base (B) comprises a first series (200) of holes aligned along a straight line and thus defining a first detachable part (B3).

Said detachable part (B3) is joined to the rest of the plane part (B1) through some contact parts (B31) spaced from one another, which are thin enough to be easily broken.

Said plane part (B1) can also comprise a second series (210) of holes aligned along a straight line that is orthogonal to said straight line defined by the first series (210) of holes, which defines a second detachable part (B4).

As shown in FIGS. 6 and 7, said radial ribs (B6) also comprise a break (B63) at the level of said series of holes (200, 210), which divides each radial rib (B6) into a first part (B61) connected to said raised part (B2) and a second part or end (B62) on said detachable parts (B3, B4).

Said first part (B61) and said second part (B62) can be joined together into a single contact part (B64) whose thickness is reduced enough to allow it to be easily broken (FIG. 6), or they can be completely separated (FIG. 7).

In a possible further solution, not shown in the figures but easy to understand, said plane part (B1) comprises a further straight cut or series of holes aligned along a straight line that is parallel to said first cut (100) or series of holes (200). Said further cut or series of holes can be conveniently arranged on the plane part (B1) in a position opposite said first cut (100) or series of holes (200) with respect to the raised part (B2).

In a possible further solution, said plane part (B1) comprises a first pair of straight cuts or series of holes aligned and parallel to each other and a second pair of straight cuts or series of holes aligned and parallel to each other and orthogonal to said first pair. Said four cuts or series of holes are arranged around said raised part (B2) and thus define four selectively detachable parts.

"Plane," "planar," "straight," and "circular" in the present description indicates "substantially plane," "substantially planar," "substantially straight," and "substantially circular." Further, "substantially" in the present description relates to possible deviations within a range of ±20%.

With reference to the above description and the attached drawings, the following claims are made.

The invention claimed is:

1. A base configured for supporting raised floors, comprising:

a planar part configured for resting and fixing the base onto a ground; and a raised part joined to and extending from the planar part, wherein the planar part is provided with a first cut along a straight line, and/or a first series of holes aligned along the straight line, the straight line dividing the planar part in a plurality of parts, so as to provide a first breaking line configured to facilitate a breaking action for a separation of at least one detachable part from the planar part.

2. The base according to claim 1, wherein the planar part has a circular shape, and wherein the breaking line is positioned on a chord of the planar part, between the raised part and a perimeter of the planar part.

3. The base according to claim 1, wherein the planar part further comprises a second cut along a second straight line, or a second series of holes aligned along the second straight line, the second straight line being orthogonal to the first line, so as to define a second breaking line identifying a second detachable part.

4. The base according to claim 3, further comprising partitions extending orthogonally from an upper surface of the planar part and arranged adjacently to the first and the second cuts or series of holes.

5. The base according to claim 3, wherein the planar part comprises a first pair of cuts, or a first series of aligned holes, parallel to each other, and a second pair of cuts, or second series of aligned holes, parallel to each other and orthogonal to the first pair, and wherein the first and the second cuts or series of holes are arranged around the raised part, thus defining four selectively detachable parts.

6. The base according to claim 3, wherein the raised part has radial ribs, and wherein the radial ribs have cuts at a location of the first and the second cuts or series of holes in the planar part, so as to make the radial ribs divided in two parts.

7. The base according to claim 6, wherein the two parts of the radial ribs are joined to each other into a single contact part having a smaller thickness than a remainder of the radial ribs so as to facilitate the breaking action.

8. The base according to claim 3, wherein the raised part has radial ribs, and wherein the radial ribs are truncated at a location of the first and the second cuts.

9. The base according to claim 1, wherein the planar part further comprises a second cut or a second series of holes aligned along a second straight line parallel to the first breaking line.

10. The base according to claim 1, wherein the first cut is made on and upper surface and/or on a lower surface of the planar part.

* * * * *